US011161651B2

(12) United States Patent
Bruns et al.

(10) Patent No.: US 11,161,651 B2
(45) Date of Patent: Nov. 2, 2021

(54) SACK AND METHOD FOR PRODUCING A SACK

(71) Applicant: Windmöller & Hölscher KG, Lengerich (DE)

(72) Inventors: Thomas Bruns, Hopsten (DE); Peter Lüttmann, Hopsten (DE)

(73) Assignee: Windmöller & Hölscher KG, Lengerich (DE)

( * ) Notice: Subject to any disclaimer, the term of this patent is extended or adjusted under 35 U.S.C. 154(b) by 0 days.

(21) Appl. No.: 15/625,026

(22) Filed: Jun. 16, 2017

(65) Prior Publication Data

US 2017/0361994 A1 Dec. 21, 2017

(30) Foreign Application Priority Data

Jun. 16, 2016 (DE) ..... 10 2016 111 030.2
Oct. 7, 2016 (DE) ..... 10 2016 119 113.2

(51) Int. Cl.

| | |
|---|---|
| ***B65D 33/06*** | (2006.01) |
| ***B31B 70/86*** | (2017.01) |
| ***B65D 30/06*** | (2006.01) |
| ***B31B 70/00*** | (2017.01) |
| ***B65D 30/00*** | (2006.01) |

(Continued)

(52) U.S. Cl.

CPC ..... *B65D 33/06* (2013.01); *B31B 70/00* (2017.08); *B31B 70/872* (2017.08); *B31B 70/874* (2017.08); *B31B 70/876* (2017.08); *B65D 29/00* (2013.01); *B65D 29/04* (2013.01); *B65D 33/004* (2013.01); *B31B 70/008* (2017.08); *B31B 70/26* (2017.08); *B31B 70/262* (2017.08); *B31B 70/266* (2017.08); *B31B 70/79* (2017.08); *B31B 70/864* (2017.08); *B31B 2150/001* (2017.08); *B31B 2155/00* (2017.08);

(Continued)

(58) Field of Classification Search

CPC ..... B65D 33/06; B65D 29/00; B65D 29/04; B65D 33/004

USPC ..... 383/117

See application file for complete search history.

(56) References Cited

U.S. PATENT DOCUMENTS 3,208,492 A * 9/1965 Braithwaite ..... B65D 33/065 383/20
5,026,173 A * 6/1991 Jensen ..... B65D 33/06 383/10

(Continued)

FOREIGN PATENT DOCUMENTS

CA 2758402 A1 * 5/2012 ..... B65D 75/566
DE 202011106245 U1 * 1/2013 ..... B65D 75/563

(Continued)

OTHER PUBLICATIONS

Machine translation of DE-202011106245-U1.*

(Continued)

*Primary Examiner* — Jes F Pascua
(74) *Attorney, Agent, or Firm* — DLA Piper LLP (US)

(57) ABSTRACT

A pinch bottom sack fillable with bulk good includes a sleeve with at least one area element, wherein the sleeve includes a mesh and the area element a handle means including a load element at which a load force is applicable for lifting the sack, and the load element is configured such that it extends at least in some areas at least in a load condition in which the load force acts at the load element opposite to an outer side of the area element.

20 Claims, 6 Drawing Sheets

(51) Int. Cl.

| | |
|---|---|
| ***B65D 33/00*** | (2006.01) |
| *B31B 70/26* | (2017.01) |
| *B31B 150/00* | (2017.01) |
| *B31B 160/20* | (2017.01) |
| *B31B 170/20* | (2017.01) |
| *B31B 155/00* | (2017.01) |
| *B31B 70/74* | (2017.01) |

(52) U.S. Cl.
CPC ..... *B31B 2155/001* (2017.08); *B31B 2160/20* (2017.08); *B31B 2170/20* (2017.08)

(56) References Cited

U.S. PATENT DOCUMENTS

| | | | | |
|---|---|---|---|---|
| 5,048,976 | A * | 9/1991 | Jung | B65D 33/08 383/10 |
| 5,186,542 | A * | 2/1993 | Seabold | B65D 5/46016 229/117.26 |
| 6,010,004 | A * | 1/2000 | Huckriede | B65D 33/14 206/525 |
| 7,670,050 | B2 * | 3/2010 | Haimerl | B65D 33/10 383/104 |
| 8,267,579 | B2 * | 9/2012 | Kruse | B65D 33/10 383/17 |
| 8,844,246 | B2 * | 9/2014 | Perick | B65D 75/566 53/413 |
| 9,493,272 | B2 * | 11/2016 | Hoedebeck | B65D 31/10 |
| 9,533,463 | B2 * | 1/2017 | Gum | B65D 75/563 |
| 9,688,441 | B2 * | 6/2017 | Koesters | B65D 33/10 |
| 2008/0080794 | A1 * | 4/2008 | Kruse | B65D 33/10 383/14 |
| 2009/0202181 | A1 * | 8/2009 | Alaux | B65D 31/10 383/7 |
| 2010/0329590 | A1 * | 12/2010 | Minkler | B65D 33/1691 383/6 |
| 2011/0033133 | A1 * | 2/2011 | Kujat | B65D 31/10 383/20 |
| 2011/0229060 | A1 * | 9/2011 | Koesters | B65D 33/10 383/21 |
| 2011/0280501 | A1 * | 11/2011 | Brauer | B65D 75/008 383/26 |
| 2015/0030265 | A1 * | 1/2015 | Stoeppelmann | B65D 33/18 383/109 |
| 2015/0049965 | A1 | 2/2015 | Gum | |
| 2016/0075481 | A1 | 3/2016 | Koesters | |

FOREIGN PATENT DOCUMENTS

| | | | | |
|---|---|---|---|---|
| EP | 1777167 | A1 * | 4/2007 | B65D 33/065 |
| EP | 2 468 650 | | 6/2012 | |
| EP | 2 998 236 | | 3/2016 | |
| FR | 2907428 | A1 * | 4/2008 | B65D 33/065 |
| WO | 2015/193914 | | 12/2015 | |

OTHER PUBLICATIONS

Extended European Search Report dated Oct. 26, 2017, of corresponding European Application No. 17170571.8, along with an English summary.

Extended European Search Report dated Oct. 26, 2017, of corresponding European Application No. 17170571.8, along with an English summary of the Office Action.

European Office Action dated Oct. 15, 2019, of corresponding European Application No. 17170571.8, along with an English summary of the Office Action.

* cited by examiner

SACK AND METHOD FOR PRODUCING A SACK

TECHNICAL FIELD

The present invention relates to a sack and a method for producing a sack.

BACKGROUND

Sacks which can be filled with bulk goods are basically known. Thereby sacks normally comprise a cover which configures the interior in which the bulk good is insertable. As bulk good often construction materials like for example cement or similar are possible wherein however for the end consumer more and more sacks for example for consumer goods are used. Thus, for example products for animals particularly animal food is often displayed in sacks. According to the product requirements these sacks are intended in different kinds of materials, wherein particularly sacks which are produced from fiber material particularly a mesh comprise a high rigidity and high possible loads. Since the fibers or tapes of the whole structure of the sack enable such rigidity particularly by their assembly, it is often a problem to provide further functional elements at the sack. Such functional elements are connected with the cover material of the sack, wherein with high temperatures, for example by welding with high temperatures, the mechanic properties of the materials can be altered such that for example a pretension in the tapes of a mesh is worn out. Thus, it can be for example difficult to provide a carry handle at a sack within the scope of an automatic production. Thereby, particularly the load introduction is problematic since normally the handle should carry the weight of the sack or should transfer the load to the cover of the sack.

From the state of the art sacks with handles are known, wherein the handles for example are arranged in a filling area of the sack such that a user of the sack grabs both handles and the load is transferred mainly divided in halves via the handles. Thereby, the handles normally are arranged at the interior of the sack parallel to the cover such that the force for lifting the handle is introduced into the sack as shear force and the connection is loaded accordingly. Thereby, however multiple disadvantages with such an arrangement result. Thus, the handles normally project from the filling opening of the sack such that the optic of the sack is affected. Further, a closing element is only possible underneath the handle assembly, particularly since the handles otherwise project through the closing element and a closing would be prevented. Therewith a great part of cover material is necessary at the upper side of the sack which however is not available for the normal function, the acceptance of bulk goods. Likewise with discharging the bulk goods from the sack by the upper side arrangement of the handles diverse disadvantages result since a deviation of the sack is difficult, particularly when the user does not use another hand for the support of the sack bottom.

It is therefore the object of the present invention to at least partially prevent the previously described disadvantages from the state of the art. Particularly it is the object of the present invention to provide a sack which comprises a high rigidity with a particularly simple construction, which can be comfortably handled and can be cost-efficiently produced.

SUMMARY

We provide a pinch bottom sack fillable with bulk goods including a sleeve with at least one area element, wherein the sleeve includes a mesh and the area element a handle means including a load element at which a load force is applicable for lifting the sack, and the load element is configured such that it extends at least in some areas at least in a load condition in which the load force acts at the load element opposite to an outer side of the area element.

We also provide a method of producing the sack fillable with bulk goods including a sleeve with at least one area element, wherein the sleeve includes a mesh and the area element a handle means including a load element at which a load force is applicable for lifting the sack, and the load element is configured such that it extends at least in some areas at least in a load condition in which the load force acts at the load element opposite to an outer side of the area element, including a) providing a flat material line including a mesh with at least a plane area, b) providing the handle means at the plane area such that with later use of the completed sack, a load force is applicable at a load element of the handle means and the load element is configured such that it at least partially extends at least in a load condition in which the load force acts at the load element opposing to the outer side of the area element, c) separating the plane area from the flat material line, and d) processing the at least one plane area to a cover of the sack.

REFERENCE LIST

Figure 1:
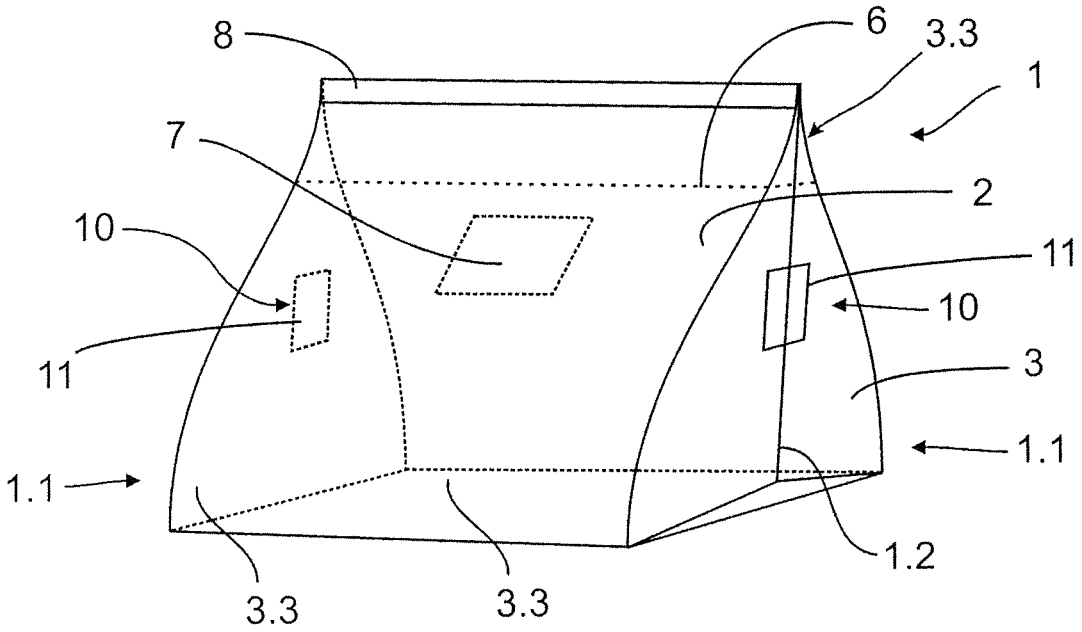
FIG. 1 shows a sack according to the invention in a schematic, perspective view of a first embodiment.

1 Sack
2 Cover
3 Area element
3.1 Inner side of area element
3.2 Outer side of area element
3.3 Further area element
4 Load force
5 Normal force

6 Filling limit
7 Display area
8 Filling area
10 Handle means
11 Load element
11.1 First end of load element
11.2 Second end of load element
11.3 Outer area of load element
11.4 First layer of load element
12 Reinforcement means
12.1 Connecting sections of a reinforcement means
13 Openings
13.1 Width
13.2 Smoothing
14 Sealing element
14.1 Connecting section of a sealing element
15 Grasping-in-area
16 Load introduction area
200 Flat material line
200.1 Transport direction
201 Plane area
201.1 First edge area
201.2 Second edge area
I Discharge condition
II Load condition

DETAILED DESCRIPTION

Thereby features and details which are described in connection with the sack according to the invention naturally also apply in connection with the method according to the invention and vice versa such that according to the disclosure of the single aspects of the invention it can always be reciprocally related to.

According to the invention a sack which can be filled with bulk goods comprises a cover with at least an area element, wherein the cover comprises a mesh and the area element comprises a handle means. Thereby, the handle means comprises a load element at which a lifting force for lifting the sack can be raised. Further, the load element is configured such that the load element, meaning the load element at least in a load state, in which the lifting force acts at the load element, projects at least area-wise opposite to the outer side of the area element. Preferably, the sack is a pinch-bottom-sack. Such a sack can preferably comprise a lateral fold and a folded bottom such that this is usable particularly efficiently for a palletizing. Further, such a form of the sack provides a simple possibility to provide a mechanism for opening like for example multiple foldings at the upper side.

As bulk goods within the scope of the present invention different materials are possible. Preferably, through the sleeve of the sack thereby an interior of the sack can be configured which is fillable with the bulk goods. Thus, a sack according to the invention can for example be suitable for the handling of animal food or food. Further, however application areas like construction materials, particularly cement or further materials preferably with a high concentration and therewith a high weight per $cm^3$, are possible. By an area element within the scope of the present invention preferably an area of the sleeve can be understood which comprises an at least partially area-wise extension. Thereby, the area element can be folded for example in an empty state of the sack such that the area-like extension is only visible in a filled state of the sack. The handle means can preferably be a handle which particularly is grippable from the outside or in which can be grabbed in particularly from the outside. By lifting of the sack with the handle means by a user the lifting force can be expended and can be introduced into the sack at the handle means. Thereby, the handle means comprises the load element. Thereby, the load element can for example indirectly or directly be assembled at the area element particularly at the outer or inner side of the area element with at least a first end of the load element particularly preferred with a first and a second end of the load element. The application of the load force can be understood such that the weight force of the sack with or without filling of the bulk goods during lifting at least partially counteracts to the lifting force such that for example a connecting area of the load element projects at least area-wise opposite of the outer side and it can therewith be understood that the load element projects relative to the outer side or in comparison to the outer side. Preferably the load element thereby at least partially projects in a direction which is mainly perpendicular to the area element and/or parallel to the lifting force. The load element can therewith for example be configured as an elevation at the area element. Preferably the load element can be spaced apart from the outer side of the area element at least area-wise. The outer side of the area element can particularly be understood as an outer surface of the area element. Preferably the load element can at least in the load state be extended arch-like at the outer side of the area element. The load state can particularly be a state of the handle means. Preferably further the load element and/or the area element can be configured flexible. Thereby, the sack can be foldable particularly easily and therewith storable in the unfilled state with only small space. Further, a flexibility of the material comprises advantages with the storing of the bulk goods since therewith the form are at least partially adjustable to the content or the load conditions. The load element can further directly or indirectly be arranged at the area element.

Therewith, a sack according to the invention is particularly easily usable. Thus, for example advantages result with pouring in case the handle means is not arranged in the filling area of the sack. Further, the handle means can be hided such that the optic of the sack is improved, wherein finally products which for example can be sold in the sack can be advertised more easily. Further, the constructive freedom which is enabled by such an assembly of the handle means is high such that diverse arrangement possibilities of the sack can result with such a handle means. Preferably a handle means according to the invention can particularly further ensure a good force transfer such that a plastic flowing in the area of the handle means is reduced or even prevented. Particularly a handle means can be sufficient for the introduction of the complete load force. Further, the constructive freedom can be projected to the handle means such that this can be configured particularly comfortable. Further, a filling area of the sack can be configured free from handle means such that the whole area of the cover can be mainly or completely used for the filling, the lock and the folding of the sack and therewith the material requirement for the sack is reduced.

By a mesh within the sense of the present invention a material can be understood which is preferably configured from stripes and tapes which for example by stretching comprise a pretension or are turned into an internal stress state. Thereby, the tapes can be arranged preferably at least partially perpendicular or mainly perpendicular towards one another such that particularly a chessboard-like weaving pattern results. Therewith the weaving pattern is preferably frequently, wherein particularly a part of the tapes of the mesh extents in parallel to one another in a first direction and another part of the tapes extents in parallel towards one another in a second direction respectively, wherein the first and the second direction are preferably perpendicular. The mesh can further preferably be surrounded by a plastic layer, wherein the plastic layer is particularly configured as a film. Thereby, an improvement of the optic can be achieved and at the same time a stabilization of the woven tapes. Thus, the tapes can be for example glued with the plastic layer or the plastic layer can be applied as a melt. Further, the tapes of the mesh comprise preferably a plastic like for example a polyolefin, particularly preferred a polypropylene. For the simple producibility the tapes can be configured from polyolefin or polypropylene. While the width of the tapes which can significantly influence the properties of the weaving pattern are between 2 mm and 4 mm, preferably between 2.3 mm and 3.4 mm, the area weight of the mesh is preferably between 50 g/m$^2$ and 100 g/m$^2$, wherein approximately 70 g/m$^2$ is particularly suitable. Further, it can be intended that the whole mesh is from polyolefin particularly preferred from polypropylene such that a pairing from two different materials is not necessary. This can for example simplify the production of the sack and therewith safe costs since only one raw material is necessary for the mesh. Thus, for example the plastic layer can comprise a particularly biaxial oriented polypropylene, wherein the layer thickness of the plastic layer can be preferably <50 g/m$^2$, particularly preferably <40 g/m$^2$. Further, an adhesion promoter material can be intended which simplifies a connection of the plastic layer with the tapes. Due to the mesh the sack therewith comprises a high rigidity with a cost efficient production and a low own weight.

Within the scope of the invention it can be further intended that the handle means can be turned into a discharging condition and in a load condition, wherein the load element in the discharging condition with an inner side and/or the outer side of the area element at least essentially flush. Thereby, the discharging state is preferably defined by that the load force does not act on the load element of the handle means or a small force acts on the load element such that the load element comprises low or only small own tension. Thus, the handle means can be preferably in the discharging state when selling the sack. Particularly for example an opening in the area element can be pre-punched such that a user initially resolves the load element for the application of the load force from the area element and subsequently transfers it to the loading state. The loading state can be a state of the handle means and further be defined in that a force acts, preferably the load force, with which the sack can for example be carried, lifted or otherwise moved. With the flush ending preferably the inner side and/or the outer side can be in one plane with the main extension direction of the area element or at least area-wise proceed tangentially to the area element. Particularly the inner or the outer area of the load element can be parallel to the inner or outer side of the area element. Thereby, a high quality optic results since the handle means can be for example hidden in the discharging condition or can be introduced into the printing image of the sack. Thereby, further advantages for the product advertising result for a product which for example can be sold in the sack. At the same time the costs which can be necessary with a separated coating of the handle means can be kept low.

It is further possible with a sack according to the invention that the load element comprises a reinforcement means, particularly wherein the reinforcement means can be arranged preferably at the center of the load element. The reinforcement means can thereby preferably be an additional component. Thus, the reinforcement means can for example be a reinforcement sheet, particularly which is arrangeable on the inner and/or outer area of the load element. Thus, the reinforcement means can for example configure a second layer underneath a first layer of the load element. Likewise the reinforcement means can comprise multiple reinforcement sheets. Preferably the reinforcement means thereby serves for a higher thickness at least in a partial area of the load element such that the load acceptance of the handle means is overall improved and therewith the rigidity of the handle means is increased.

With the sack according to the invention it can be an advantage that the reinforcement means is arranged at the area element and/or at the load element, particularly wherein the reinforcement means can be welded with the area element and/or load element. Particularly the reinforcement means can configure a second layer underneath the first layer of the load element. Preferably thereby the reinforcement means can be in material connection with the area element and/or load element, particularly preferably it can be hot air welded or glued. This enables a reliable connection of the reinforcement means with the area element and/or the load element with a small effort, wherein a hot air welding of the reinforcement means comprises at least the advantage that a clean connection is enabled without glueing rests on the sack without the necessity of high welding temperatures. A glueing however has at least the advantage that the glue which can preferably be a hotmelt glue is particularly cheap, and further equipment for the production of the connection can be kept simple since only an application of the glue is necessary. The reinforcement means can thereby further be preferably arranged on the outer and/or inner side of the area element. Likewise the reinforcement means can be arrangement on the outer and/or inner area of the load element. The arrangement of the reinforcement means on the inside of the load element and/or area element has thereby at least the advantage that the reinforcement means at least with the first impression of the sack cannot or only hardly be recognized such that the optic of the sack is not affected by the reinforcement means and that the reinforcement means can be for example produced cost-efficiently, particularly since it is not directly visible. An arrangement of the reinforcement means on the outer side has the advantage that the reinforcement means at the same time can be used for highlighting the handle means such that a user of the sack is particularly directly pointed to the existence of the handle means and does not overlook the handle means. Further, the reinforcement means can at the same time provide a protection at least for the load element in relation to environmental conditions in case the reinforcement means is arranged at the outside.

It is further an advantage that with the sack according to the invention the reinforcement means can be configured from one piece with the load element. Thereby the load element can preferably be generated by arranging the reinforcement means particularly a reinforcement sheet at the area element such that only one production step is necessary in order to arrange the load element with a sufficient rigidity at the area element. At the same time thereby the amount of the necessary components can be reduced such that the production costs for the sack are further reduced.

It is further possible that the handle means in the area element and/or in the reinforcement means with the sack according to the invention comprises at least one opening such that the load element is movable. Such an opening can for example be an interruption in the area element. Thus, the mesh of the area element cannot for example in this area be at least partially connected such that the load element is movable at least partially in a certain area of the load element relative to an area of the area element. Preferably, two openings can be intended such that the load element is arranged between the two openings. By the intention of an opening in the area element and/or in the reinforcement means by simple production methods, like for example a separation of the material, by cutting or punching, a high freedom of movement of the load element and/or a simple production method of the same results. By the provision of a single opening in the area element therewith particularly also the load element in the load condition can only partially project from the outer area of the area element such that a user can grab the load element with the hand and the load force is at least partially transferable via a curvature in which the load element can continuously merge into the area element. Particularly, the opening can comprise an incision. Thus, for example by provision of at least one, preferably two openings the load element can be produced or a passage can result from the opening in the area element through which the load element can be guided such that for example the load element can be arranged at the inner side of the area element. By an incision preferably a separation of the material can be understood particularly wherein the width of the incision is zero or mainly zero and/or with introducing the incision preferably no material removal occurs. Further, the opening can extend preferably along the load element.

Within the scope of the invention the opening can further preferably be a recess which can preferably comprise the width of 2 mm to 5 mm. Thereby, the width can project perpendicularly to the main extension direction of the load element or the opening. Such an opening has the advantage that it is simple to produce and has a low influence on the rigidity of the sack or the handle means. Thus, the structure of the mesh is only slightly separated and by a corresponding configuration however strength promoting forms of the invention can be intended. Further, the insertion of the user into the handle means by the configuration of the opening as a recess can be simplified particularly with said width.

Within the scope of the invention it is further possible that the opening parallel to the load element comprises a length of >90 mm, preferably of 100 mm to 180 mm. Thus, the load element can preferably comprise the same length like the opening with a configuration in one piece with the area element, wherein the length extends in parallel to the load element. Therewith, the advantage results that a load introduction with application of the load force is particularly efficient, since the load element of the handle means can be bended in a rigidity promoting manner. Therewith, at the same time a high carry comfort for the user can be provided.

Preferably at least a first layer of the load element with the area element can be configured in one piece with a sack according to the invention. Particularly the load element can be completely configured from one piece with the area element. Therewith, here a simple production possibility of the handle means or parts of the handle means is ensured such that particularly the amount of components can be reduced. Thus, for example the load element can be configured by the intention of an opening in the area element. Therewith particularly the outer side of the area element and the outer side of the load element can be continuously merged. This can be particularly cost-efficient in the production and by an effective force flow affect the high rigidity of the handle means. Further, at least or only one upper or lower layer of the load element can be configured in one piece with the area element such that said advantages result, wherein the other side of the load element at the same time can be reinforced by a reinforcement means respectively.

It is further possible with a sack according to the invention that the opening in the load inlet area of the handle means comprises a smoothing. Thereby, by a smoothing preferably a radius of a circular, oval or elliptic edge can be understood. Further, the smoothing can preferably be a circle which is particularly stamped at the edge of one separation. Thereby a tear propagation resistance of the mesh can be improved, wherein the tear progatation resistance of the mesh can preferably be a resistance of the material against crack propagation in this area. Thereby, particularly in the load introduction area of the handle means it is an advantage that here a strong local stress can result. Thereby, by a load inlet area of the handle means the area can be understood which is particularly directly at the load element or next to the load element such that in the load inlet area for example the load from the load element is introducible into the area element and/or the reinforcement element. Thus, the load inlet area can be in a first and/or second end of the load element and particularly an arrangement area of the load element, wherein the opening can project into the load inlet area or can adjoin to it. By the smoothing therewith a reduced notch effect can be achieved.

It is further possible that with a sack according to the invention the handle means comprises a flat sealing element which is arranged at the opening such that a leakage of bulk goods through the opening is prevented, wherein the sealing element is connected with the area element particularly circumferential about the opening. By the intention of the opening at the sack a position can result at which bulk goods escape from the sack, wherein this is prevented by an laminar sealing element. Further, for example with a crack propagation which can result within the course of the use, particularly in the load introduction area of the handle means, likewise a leakage can result, particularly in case the material of the area element and/or the reinforcement means start to plastically flow due to the stress. Likewise here the sealing element at least within the scope of a tolerance which is mainly determined by the size of the sealing element can prevent or at least delay the loss of bulk goods with the rupture of the material. Since the bulk goods for example, in case it is consumer goods, is in the focus of the end consumer, the avoidance of the leakage of the bulk goods improves the quality of the sack particularly in the view of the end consumer such that this can affect the eventual further purchase of the product. Further, the sealing element can vice versa protect the bulk goods from environmental influences particularly from moisture or liquids. Thus, the sealing element can preferably be configured as a sealing sheet which is applicable preferably on the inside of the area element and/or the reinforcement means. By the area-like particularly flat configuration of the sealing element further only a small construction space is necessary. With a circumferential connection of the sealing element the connecting section of the sealing means can directly surround the opening or comprise a further area such that for example a second opening is underneath the circumferention of the connection. Thereby, particularly a connecting section of the sealing element is sufficient in order to seal multiple openings.

Preferably, with a sack according to the invention the handle means can comprise a grasping-in-area which is at least configurable by the load element, particularly wherein the load element in the grasping-in-area is at least grabable mainly in parallel to the outer side of the area element. Therewith, by the intention of the grasping-in-area the user can grab the handle means with the hand and therewith introduce a load from the lower side of the load element into the load element or the handle means. Thereby, results a particularly simple possibility for realizing the load element according to the invention and a high carry comfort for the user during grabbing of the load element. Further, the load element can at the same time be folded up or folded out and therewith be transferable from the discharging condition into the loading condition, wherein the load element in the discharging condition can be particularly optically covered.

Within the scope of the invention it can be further intended that the load element and/or the grasping-in-area is configured without a sealing element. Thereby, for example it can be intended that the sealing element does not project into the grasping-in-area at the lower side of the load element such that a user does not recognize an edge with the passage from the sealing element to the sealing element-free section during carrying. Thereby, the carry comfort can be further improved. Particularly further the sealing element is not directly loaded such that only a low requirement for the sealing element is provided in relation to the rigidity. Further, a contamination of the sealing element can be reduced such that it is not optically influenced by the pollution and is not significantly reduced in its rigidity.

Preferably with the sack according to the invention the sealing element can be materially bonded with the reinforcement means and/or the load element. Like the reinforcement means the sealing element can be preferably glued or hot air welded such that a secure connection results with a simple production possibility.

With a sack according to the invention preferably at least one connecting section of the sealing element can be arranged in the grasping-in-area of the load element. Therewith, the sealing element can further support or improve the load introduction from the load element into the area element. Preferably, the connecting section can further comprise curves and/or in the load inlet area of the handle means can be tangential to the curves of the opening. This can for example be understood by a curving of the outer radius which preferably partially or completely extents over the width of the connecting section. Such a curving can further improve the force-fit and therewith the rigidity such that the reliability of the handle means during carrying of the sack can be further improved. Thus, a tangentiality in the load introduction area for the improvement of the force-fit is suitable such that this further improves the rigidity of the handle means.

Preferably, with a sack according to the invention it can be intended that the area element, the load element and the reinforcement means and/or the sealing element are materially uniform. Therewith, preferably each of the components can comprise a mesh or be made out of a mesh, particularly comprise the same mesh or be from the same mesh. This enables a particularly simple connection of the components since the connection is adjusted to the properties of the single material or material type. Further, this can favor the rigidity since the mesh can comprise a high rigidity. Further, the production costs can be promoted by being made out of one material such that less different materials have to be handled.

It is further possible with a sack according to the invention that the area element is a lateral area of the sack particularly wherein the area element comprises a lateral fold. Therewith the lateral area is preferably foldable such that in the unfilled state the sack comprises only small transport sizes and therewith multiple sacks can be stored in a small space. Further, the handle means is assembled covered in the lateral area of the sack such that the optic of the sack is not influenced by the handle means. Further, by the intention of the handle means in the lateral area a comfortable pouring out of the bulk material from the sack is enabled. Preferably it can be intended that a second handle means is arranged at a second area element of a lateral area of the sack opposite to the lateral area of the sack. Thereby a carrying of the sack with two hands, alone or for example by two persons is enabled, wherein the load during the carrying is distributed particularly efficiently since the center of gravity is particularly in the center.

Within the scope of the invention it can be further intended that the cover comprises a filling limit, wherein above the filling limit a filling area is intended at which the bulk goods can be emptied out of the sack and the handle means is intended underneath the filling limit. The filling area can thereby for example comprise a quick lock, a seam or a glueing such that the sack can be easily opened at this area by the user. Owing to the quick lock it can even be intended resealable. By the assembly of the handle means below the filling limit an efficient force distribution results when the sack is carried or when the sack is tipped over. Thus, for example a simple tipping over of the sack from the wrist can be sufficient for a discharging process when the handle means is positioned particularly advantageously. Further, a buckling of the area element with an insertion of the load force is reduced when the sack is stabilized in the surrounding of the handle means at least partially by the bulk goods. Further, thereby particularly the handle means can preferably be underneath the center of gravity of the sack particularly when the sack is filled with bulk goods. Thereby the emptying of the bulk goods can be further simplified at least for the completely filled sack since the weight of the bulk goods generates a momentum during tipping of the sack which can further support a further tipping and therewith emptying. Particularly the filling limit can result by the form of the sack such that a specially marked filling limit is not necessary.

Preferably further the outer side of the area element and/or an outer side of the load element can be coated by a sack according to the invention. By a coating preferably a printing, vanishing and/or a laminating can be understood. This can on one hand improve the optic of the sack and at the same time improve the rigidity of the cover. Further, a protection against environmental influences can be improved by the coating, wherein at the same time the production costs can be reduced by a simple printing on the coating.

Within the scope of the invention it can be further intended that the sack comprises a display area in order to guide a user to the handle means. Thereby the display area can point the user for example to the position or in general to the existence of the handle means. Therewith an improvement of the optic of the handle means can be covered and at the same time be simply locatable by the user.

Further, the load element can be configured with a sack according to the invention such that by the load force at least mainly a normal force can be introducible into the area element. That by the load force mainly a normal force is introducible into the area element can be understood within the scope of the present invention in that the area element at least partially or mainly is resilient to bending. By the normal force preferably a force can be understood that at least acts mainly perpendicular to the area-like extension of the area element. Thereby, the normal force configures preferably a component of a force acting in another direction, wherein such a component is only existent when the force differs from a shear force and not only acts in the plane of the area-like extension of the area element. Preferably, the normal force can act in parallel to the load force. Further, the normal force, for example particularly as a cutting force, can act within the material such that the transfer of the load force can for example result in a local bending and/or diffraction of the area element. Particularly the normal force can be introducible in the connecting area between the area element and the load element of the handle means into the area element. Thereby, such a configuration of the handle means or the load element results in a high rigidity of the handle means since the load introduction is distributed and therewith the distress is kept low. Further, thereby the connecting area of the components cannot be or only be slightly stressed by a shear force and therewith the requirement to the connection per se is reduced.

According to a further aspect of the invention a sack, particularly a pinch bottom sack, is claimed which is fillable with bulk goods and comprises a cover with at least one area element, wherein the cover comprises a fleece material and the area element comprises a handle means which comprises a load element at which a load force for carrying the sack is applicable. Thereby, the load element is configured such that it projects, at least in a load state in which the load force of the load element acts at least partially, opposing to the outer side of the area element. Thereby, features and details which are described in connection with a sack according to the invention comprising a mesh naturally also apply with a sack according to the invention comprising a fleece such that according to the disclosure of the single aspects of the invention it can always be reciprocally related to. Further, the shown embodiments of a sack are transferable to a fleece material. Thereby, a sack according to the invention comprising a fleece material comprises the same advantages like they are described in detail in relation to the sack according to the invention with a mesh. Particularly, a fleece material can be producible cost-efficiently and comprise an even surface.

According to a further aspect of the invention a method for the production of a sack, particularly according to one of claims 1 to 21, which is fillable with bulk goods, is claimed. Thereby, at least the following steps are performed:

a) Providing a flat material line comprising a mesh with at least one flat area,
b) Provision of such a handle means at the flat area that with the later use of the complete sack a load force at the load element of the handle means is applicable and the load element is configured such that at least in a load state, in which the carry force acts at the load element, projects at least partially opposite to an outer side at the area element,
c) Separation of the flat area from the material path,
d) Processing of the at least one flat area to a cover of the sack.

Thereby, the provision of the flat material line can for example occur such that initially a tube is woven, wherein weaving can be particularly an arrangement of plastic tapes in a regular crossing sequence. Further, the tube can be preferably separated such that with spreading of the tube material the flat material line results. Therewith, a continuous strand from mesh is generated which in the following production station results in a flat material line. Thereby, the flat material line comprises at least one flat area at which the handle means is provided. The separation of the flat area according to step c) can preferably occur after a provision of the handle means according to step b) or for example previous to step b) such that initially the flat areas are separated and subsequently the handle means is applied to the separated flat areas. The processing of the cover section to a cover can preferably occur such that the flat area is folded along the later fold edges of the sack, wherein those can preferably be located diagonally to one another. By a flat area further preferably a section of the material path can be understood which configures with the production of the sack at least a section of the cover of the sack. Preferably, the material path can comprise multiple flat areas which particularly follow-up one another. Therewith, particularly a high degree of automatization can be reached when the material path comprises continuously further flat areas which can be processed according to the steps b) to d) or a) to d).

Therewith, a method according to the invention comprises the same advantages like they are described in detail in relation to a sack according to the invention. Thereby, the method for the production of the sacks can be preferably automatized since at least the method steps a) to d) are at least mainly performable by a machine. Therewith, preferably a strand of mesh material can be generated which is for example moved with approximately 70 m/min. By the automatization the method can be cost efficient and a high quality in the accuracy with the placing of the handle means with separation of the flat area and with processing of the flat area to the sleeve and with the generation of the mesh can be achieved.

Within the scope of the invention can be further intended that step a) comprises at least the following partial steps:

Application of a cover on the material path such that the outer side of the area element of the sack is covered.

With the covering it can be particularly a varnishing and/or a laminating. Particularly, the application of the coating can occur to an early or late time point during the process, wherein for example the coating can be already applicable to a woven tube or be applicable to the particularly separated flat areas. Thereby, a protection of the material from environmental influences and an improved rigidity result. Further, a coating which can provide a further coating can be simplified by the first coating such that the colour sticks better to the sack. Further, the coating printing and further coatings can be applied alternately such that initially a surface favouring the printing is produced which is subsequently printed and subsequently a protection coating is applied to the printing.

Preferably step b) can comprise at least the following partial step:

Application of a reinforcement means to the flat area.

Thus, for example reinforcement means can be applied in constant distances to the flat areas such that each flat area which preferably subsequently configures a cover section comprises a reinforcement means. Thus, preferably the reinforcement means can be a reinforcement sheet which is materially bonded with the flat area or the material path. Likewise the application of the reinforcement means is therewith possibly automatized, wherein a simple machine can be used for the production. Thus, for example with an ongoing material a rotating element is intended which, for example, sets and connects the reinforcement means, for example in form of reinforcement sheets. Particularly, thereby that the reinforcement means are applied to the material path in a raw state, in this point in time hardly any other components have influence on the position of the reinforcement means such that tolerances of further components have to be not or only little taken into account. This further supports the automatized production and therewith the costs for the production of the sack.

Further, it is possible that with a method according to the invention step b) comprises at least the following partial step:

Introduction of at least one opening into the flat area and/or the reinforcement means.

By the introduction of the opening into the flat area, for example a load element of the handle means can be produced, which is configured from one piece with the flat area. Further, the reinforcement means can extend over the load element, wherein the openings for example are introducible to the flat area and the reinforcement means at the same time such that the load element can be configured with the flat area and/or the reinforcement means. Likewise this step is possible in a simple automatized process of the production such that a cost efficient production results. Thereby, the introduction of the at least one opening by a cutting and/or stamping process occurs. Thus, for example a rotating stamp can be intended which introduces openings into the flat area in periodic distances such that a simple production is enabled which can be particularly reliable by the low error prone.

Within the scope of the invention it can be further intended that the production of the flat area to a cover comprises at least the following steps:

Separation of the at least one flat area,

Preferably repeated folding of the flat area,

Joining of at least one first edge area of the flat area with the second edge area of the flat area or a further flat area.

Thereby, the sack can be produced automated and/or in a material-saving manner by simple production steps. Thus, by a separation of the at least one flat area it can for example be understood that this flat area takes another direction from the running material flow or is otherwise further processed. By folding the flat area for example preferably a pinch bottom sack or at least cover section of a cover of a pinch bottom sack can be produced. Further, the sack can be produced for example from a simple flat area only by folding and connecting of two edge areas. Further, a simple flat area can be combined with further flat areas in order to reach a cover of the sack from multiple components. Particularly, a first folding of the flat area previous to the separation of the flat area and a second folding of the flat area can occur after the separation.

Within the scope of the invention it can be further intended that step b) comprises at least the following partial steps:

Application of a flat sealing element to the flat area, wherein the sealing element is connected with a flat area, the reinforcement means and/or the load element.

Particularly, the application of the sealing element occurs such that this is assembled above the opening such that a loss of bulk goods through the opening is prevented. Therewith, the sealing element can protect from a loss of bulk materials and on the other side can provide a protection of the bulk materials itself by protecting it from environmental influences by the sealing element. Preferably, the connection of the sealing element with the flat area, the reinforcement means and/or the load elements can occur such that initially a release lacquer is applied to the areas over which the assembled sealing elements should be extended and only afterwards the connection occurs. Thereby, the connecting sections can be configured reliably and with a high accuracy. Thus, for example it can be intended that the sealing element does not extend into the grasping-in-area of the handle means such that the user does not sense an edge and therewith the comfort during lifting of the sack is improved.

Preferably, the steps of the method can be performed in the series a) to d). As far as technically meaningful, however each single step or all steps can be repeated, for example in order to ensure a series production. Further, as far as technically meaningful another order of the steps a) to d) is possible. Particularly, it can be intended that the flat area or at least one of the flat areas is configured to a tube before this is separated and subsequently closed to a cover in order to further save costs.

According to a further aspect of the invention a method for the production of the sack is claimed, which is fillable with bulk goods and comprises a fleece. Therewith at least the following steps are performed:

aa) Provision of a flat material line comprising a fleece with at least one flat area, bb) Provision of such a handle means at the flat area that a load force is applicable with a later use of the completed sack at the load element of the handle means and that the load element is configured such that at least in a load state, in which the load force acts at the load element, it projects at least partially opposite to an outer side of the area element, cc) Separation of the flat area from the material path, dd) Processing of the at least one flat area to a cover of the sack.

Thereby, features and details which are described in connection with the method for the production of the sack comprising a mesh, naturally also apply in connection with the method according to the production of the sack comprising a fleece such that according to the disclosure of the single aspects of the invention it can be always reciprocally related to. Further, the shown embodiments of a method for the production of a sack comprising a fleece are transferable. Therewith, a method according the invention for the production of a sack comprising a fleece comprises the same advantages like they are described in detail for a method according to the invention for the production of a sack comprising a mesh.

Further, improving measures of the invention result from the subsequent description for some embodiments of the invention which are schematically shown in the figures. All features and/or advantages known from the claims, the description or drawings including constructive details, spatial arrangement and method steps can be essential for the invention each single for themselves or in any combination. Thereby, it has to be respected that the figures only comprise describing character and are not designed to restrict the invention in some way.

In the subsequent figures for the same technical features even in different embodiments the identical reference signs are used.

FIG. 1 shows a sack 1 according to the invention in a first embodiment in a schematic perspective view. With the shown sack 1 it is particularly a pinch bottom sack or a pinch boden sack, wherein however also other kinds of sacks are possible. The sack 1 is fillable with bulk goods, wherein a filling limit 6 is provided, up to which the sack 1 is preferably fillable with bulk goods. The filling limit can preferably be closed by one or multiple foldings. Above the filling limit 6 a filling area 8 is intended through which the bulk goods are releasable from the sack 1. In order to accommodate the bulk goods the sack 1 comprises a cover 2 which again comprises a mesh. The cover 2 and the sack 1 are folded multiple times such that multiple area elements 3, 3.3 result. At least one of the area elements 3 thereby comprises a handle means 10 which comprises a load element 11 for an application of a load force 4 or for a transfer of the load force 4 to the area element 3. The load element 11 is thereby configured such that at least in a load condition II in which the load force 4 acts at the load element 11 it extends according to the outer side 3.2 of the area element 3 at least partially. By the load force 4 a normal force can be insertable into the area element 3, particularly at least partially or mainly. The area element 3 which comprises a handle means 10 is thereby particularly a lateral area 1.1 of the sack 1, wherein the lateral area 1.1 comprises a lateral fold 1.2. The handle means 10 is assembled preferably mainly symmetrically to the lateral fold 1.2 such that the handle means 10, particularly the load element 11 of the handle element 10, comprises likewise a lateral fold 1.2. Thus, the sack 1 can be folded flatly in the unfilled state such that a needed storing space for the sack 1 is reduced in case the sack 1 is not filled. Further, the sack 1 comprises a second handle means 10 at a side of the sack 1 opposing to the lateral area 1.1. Additionally or alternatively, however the handle means 10 or a further handle means can be intended at each of the further flat areas 3.3. In order to make it easy for a user of the sack 1 to find the handle means 10, further a display area 7 is intended on the cover 2 of the sack 1 which for example can give a hint to the user that the handle means 10 exists or at which position of the sack 1 the handle means 10 can be found. Preferably, the handle means 10 can be a handle means of one of the following embodiments, particularly of FIGS. 2 to 8.

Figure 2A:
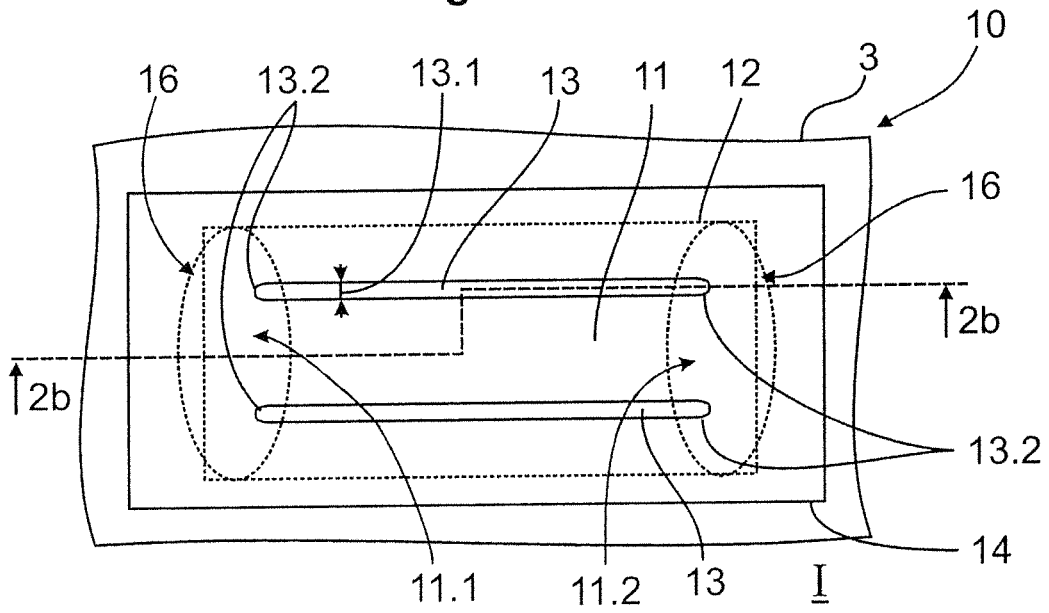
FIGS. 2*a* and 2*b* show a handle means of a sack according to the invention in a second embodiment in a schematic representation.

FIG. 2*a* shows a handle means 10 of a sack 1 according to the invention in a second embodiment. Thereby, the handle means 10 comprises a load element 11. Thereby, an upper first layer 11.4 of the load element 11 is configured in one piece with an area element 3 of a cover 2 of the sack 1 which is here schematically represented in a section. Parallel to the load element 11 two openings 13 extend which comprise smoothings 13.2 in a load introduction area 16 of the handle means 10 at the area element 3. Therefore, the load element 11 is connected to the area element 3 at a first and a second end 11.1, 11.2 of the load element 11. Thereby, the rigidity of the handle means 10 is increased since during a load of the load element 11 by said configuration the edges of the openings 13 tension peaks can be reduced such that a further tearing rigidity of a mesh of the area element 3 is improved. The smoothings 13.2 of the opening 13 particularly comprise a radius which corresponds to half of the width 13.1 of the opening 13, particularly such that the openings 13 are particularly simply producible. The width 13.1 of the openings 13 can preferably comprise 2 mm to 5 mm. Further, the load element 11 comprises a reinforcement means 12 which is at least partially connected with the load element 11. Thereby, the load element 11 and the reinforcement means 12 can be arranged by gluing or hot air welding, wherein in case of gluing preferably a hot melt glue is used such that particularly glue residues outside the glue area are reduced. Further, a plane sealing element 14, particularly a sealing sheet is provided which is arranged at the openings 13 such that a loss of bulk goods through the opening 13 is prevented. Thereby, the sealing element 14 is circumferentially connected with the area element 3 about the openings 13. Further, the handle means 10 is in a discharge condition I in the presentations of the FIGS. 2*a* and 2*b*. Thus, FIG. 2*b*, which shows particularly a sectional view of an embodiment of FIG. 2*a*, shows that the load element 11 terminates at least mainly flush with the outer side 3.2 and the inner side 3.1 of the area element 3 in the discharge condition I, such that the outer side 3.2 of the area element 3 particularly continuously merges in an outer area 11.3 of the load element 11. Thereby, for example, particularly easily a coating and/or printing is applicable or already applied to the outer side 3.2 and the outer area 11.3. Further, it is shown in FIG. 2*b* that the openings 13 are introduced into the area element 3 and the reinforcement means 12 such that the load element 11 can move partially or can detach from the area element 3.

Figure 2B:
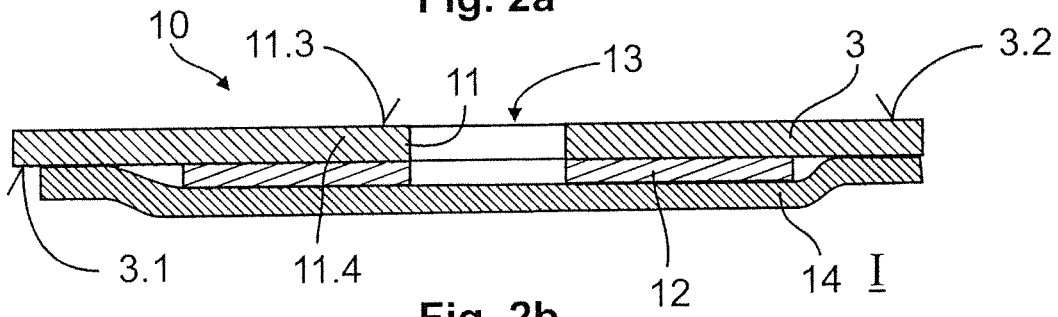
Figure 3:
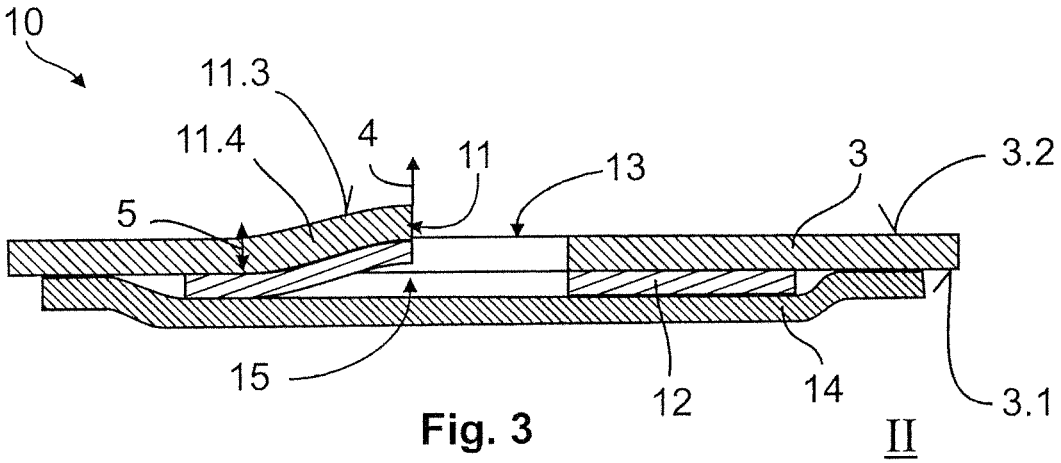
FIG. 3 shows a handle means of a sack according to the invention of the second embodiment in a load condition in a schematic representation.

FIG. 3 shows a handle means of the second embodiment of FIGS. 2*a* and 2*b* in a load condition II. Thereby, the load element 11 of the handle means 10 is loaded by a load force 4 such that the reinforcement means 12 is raised in the area of the load element 11 likewise from the area element 3. During lifting of the load element 11 from the area element 3 further an grasping-in-area 15 results between the load element 11 and the area element 3 or between the load element 11 and the sealing element 14 in which a user can grab into during carrying the sack. Preferably, this grasping-in-area 15 can be generated initially by a slightly lifting of the load element 11 such that the user can grab into the grasping-in-area 15 and can comfortably effort the load force 4. By the load force 4, particularly at least partially or mainly a normal force 5 can be introducible into the area element 3, particularly such that the area element 3 is at least partially demanded for bending. Thereby, the normal force 5 can be preferably a cutting force whose existence is expressed by bending of the area element 3.

Figure 4:
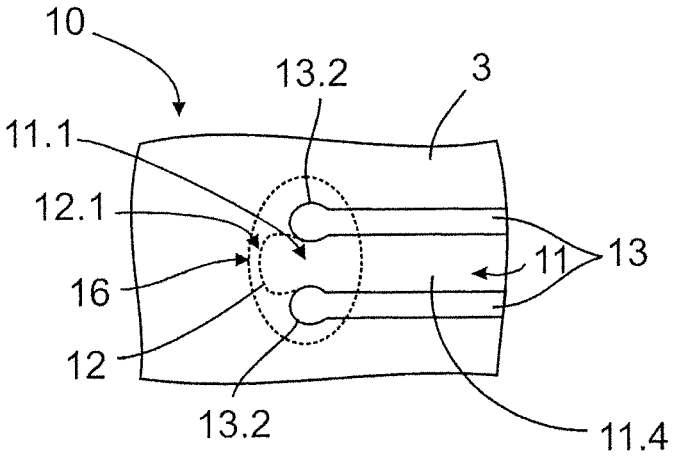
FIG. 4 shows part of the handle means of a sack according to the invention in the further embodiment in the top view in the schematic representation.

FIG. 4 shows a partial view of a handle means 10 according to the invention in a further embodiment with a first edge element 11.1 of a load element 11, wherein the load element 11 comprises a reinforcement means 12. Further, in a first layer 11.4 the load element 11 is configured from one piece with the area element 3, wherein openings 13 are introduced in the area element 3 and the openings 13 comprise at smoothings 13.2*a* load introduction area 16 at a first end 11.1 of the load element 11 of the handle means 10. In the load introduction area 16 further preferably at least a part of the load force 4 is transferred from the load element 11 to the area element 3. Further, the reinforcement means 12 is arranged in the centre of the load element 11 and is connected with the area element 3, particularly at the inner side 3.1 of the area element 3, wherein the reinforcement means 12 proceeds in the load introduction area 16 at least partially tangential to the smoothing 13.2 of the opening 13. Thereby, further the connecting section 12.1 of the reinforcement means 12 which connects the reinforcement means 12 with the area element 3 is likewise configured rounded such that here the force flow from the load element 11 into the area element 3 is favoured, such that possibly low sharp edges result and therewith the rigidity of the sack 1 is improved according to the crack propagation.

Figure 5A:
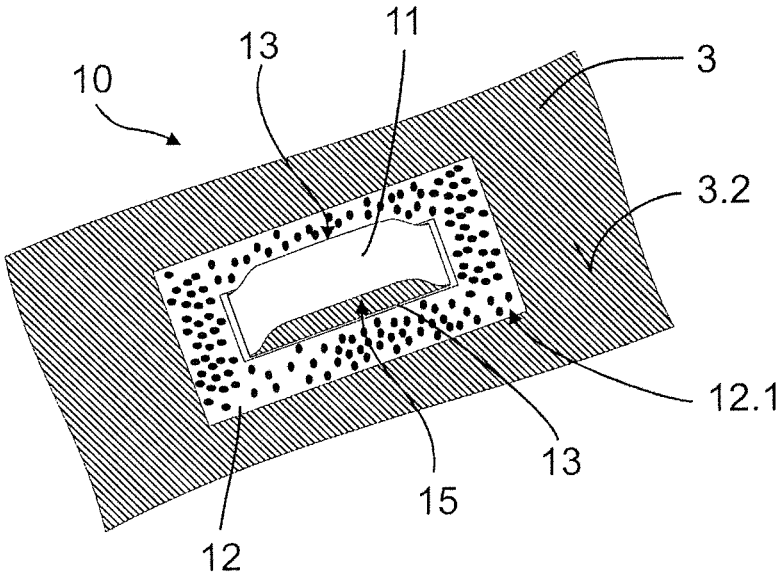
FIGS. 5*a* and 5*b* show a handle means of a sack according to the invention in a further embodiment in a schematic representation.
Figure 5B:
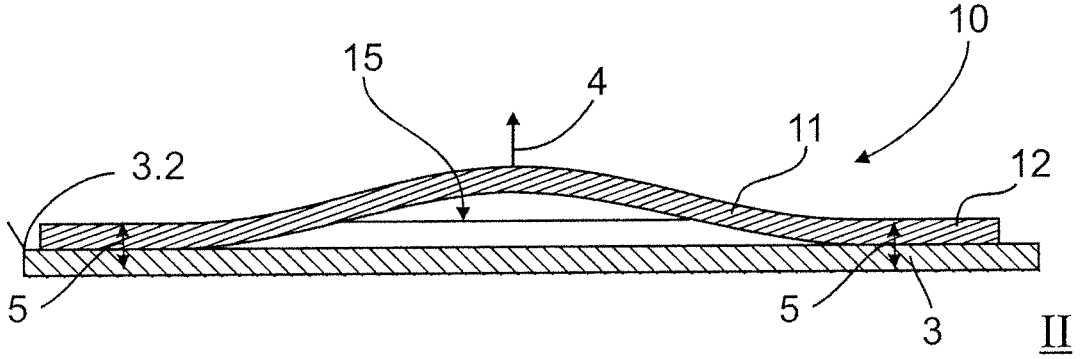

FIG. 5*a* shows a handle means 10 according to the invention of a sack 1 with a further embodiment in a schematic perspective view. Thereby, the handle means 10 is arranged at an outer side 3.2 of the area element 3 and is provided from one piece with the reinforcement means 12. Into the reinforcement means 12 further openings 13 in form of cuttings are introduced such that a load element 11 is moveable at least partially mainly independently from the area element 3. Since the load element 11 particularly comprises the same length as the openings 13, the movability of the load element 11 and/or the area element 3 are flexibly configured such that the load element 11 can be easily deformed at least in the area of the handle means 10 in order to enable the movability of the load element 11. In case that the load element 11 is detached at least partially from the area element 3 at the opening 13 at least one grasping-in-area 15 results which serves for the fact that the load element 11 can be grippable by a user such that a load force 4 is introducible from the lower side into the load element 11. A connecting section 12.1 of the reinforcement means 12 is further intended circumferential about the load element 11 (here shown with a dotted line) such that a high stability of the handle means 10 is ensured. By such a configuration of the handle means 10, wherein the load element 11 is applied particularly from the outside to the area element 3, an additional sealing is not necessary since the opening 13 is only intended in the reinforcement means 12 and therewith the area element 3 is not damaged and a loss of bulk goods to the opening 13 is therewith prevented. Thus, FIG. 5*b* shows for example the embodiment that the handle means 10 of FIG. 5*a* in a loading condition II, wherein by an acting of a load force 4 the grasping-in-area 15 is configured. By the shown configuration of the handle means 10 the load element 11 can be configured in the load condition II and in a discharge condition I similar or equal. By the load force 4 in the load condition II, particularly at least partially or mainly the normal force 5 is introducible into the area element 3, preferably such that the area element 3 is at least partially determined for bending.

Figure 6:
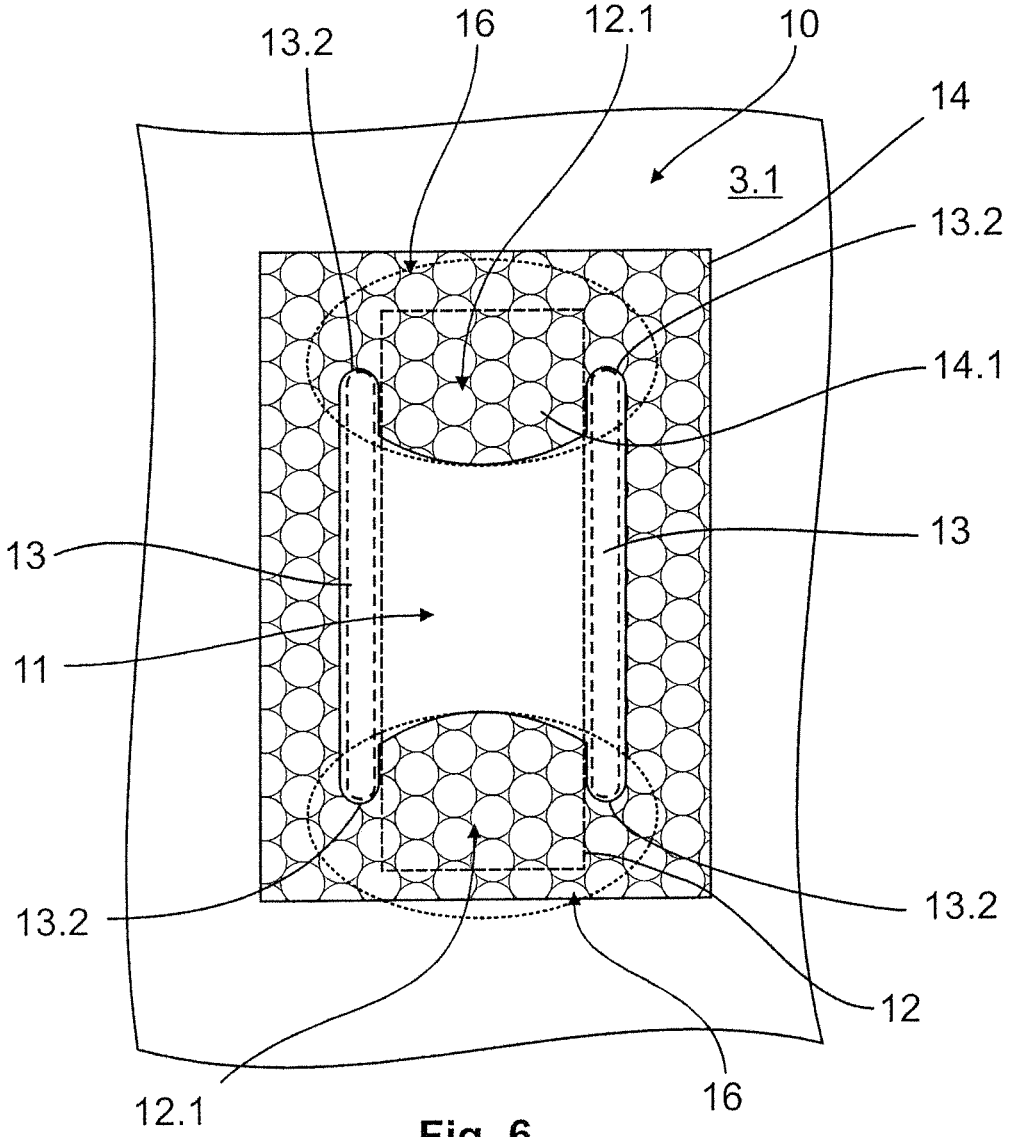
FIG. 6 shows a handle means of a sack according to the invention in a top view in a further embodiment in a schematic representation.

FIG. 6 shows a handle means 10 of a sack 1 according to the invention with the further embodiment in the top view from the inner side of the sack 1. Thereby, a load element 11 of the handle means 10 is configured such that openings 13 are introduced in an area element 3 of the sack 1 such that at least one first layer 11.4 of the load element 11 is configured from one piece in the area element 3. Thereby, the handle means 10 further comprises a reinforcement means 12 which is arranged in the centre of the load element 11 such that the rigidity of the handle means 10 is improved. At the inner side 3.1 of the area element 3 the reinforcement means 12 is particularly materially connected by two connecting sections 12.1 of the reinforcement means 12 with the area element 3. Thereby, the force transfer of the load element 11 can be distributed particularly effectively over a great area of the area element 3. Further, at the inner side 3.1 of the area element 3 a plane sealing element 14 is arranged which is connected circumferentially about the openings 13 with the area element 3 and partially with the reinforcement means 12, such that a loss of bulk goods through the openings 13 is prevented. Likewise in this embodiment the openings 13 comprise in the load introduction area 16 of the handle means 10 smoothings 13.2 in order to counteract a tearing formation. Thereby, a connecting section 14.1 of the sealing element 14 is configured at least partially tangential to the openings 13 and their smoothings 13.2, wherein the connecting section 14.1 (here shown with circles) of the sealing element 14 at least in the load condition II, particularly of the handle means 10, at least partially extends into the grasping-in-area 15 of the load element 11 and is likewise configured rounded in the grasping-in-area 15. Thereby, the sealing element 14 can likewise support the rigidity of the handle means 10.

Figure 7A:
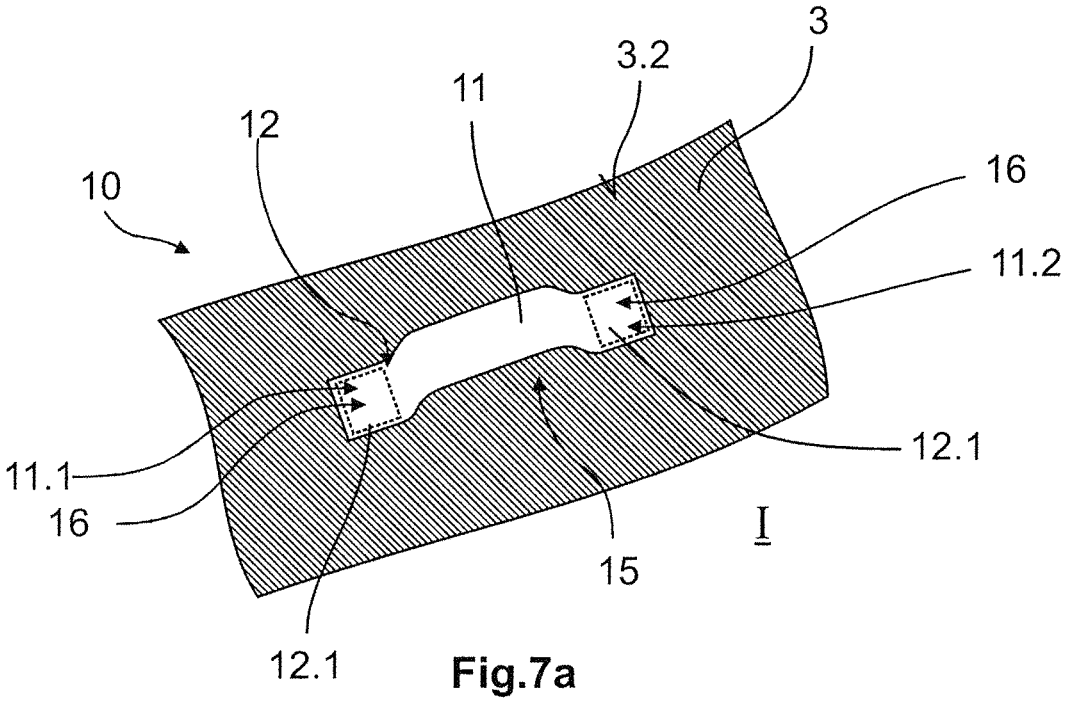
FIGS. 7*a* and 7*b* show a handle means of a sack according to the invention in a further embodiment in a schematic representation.
Figure 7B:
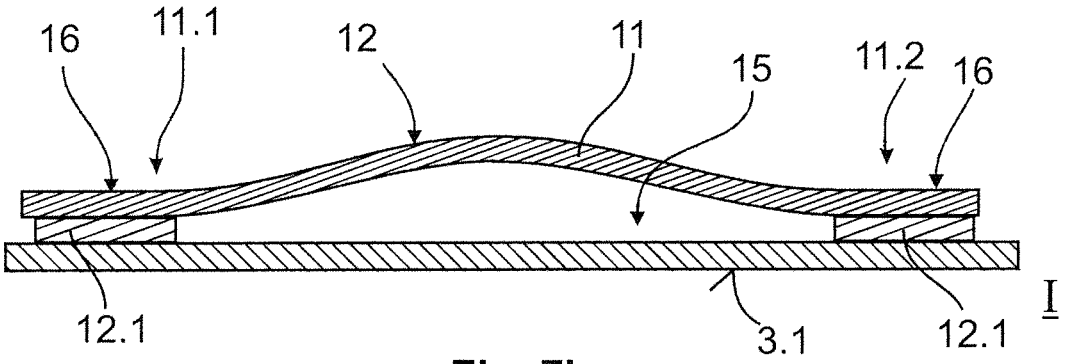

FIG. 7*a* shows a handle means 10 according to the invention of a sack 1 at the outer side 3.2 of an area element 3 in a schematic perspective view. Thereby, a load element 11 of the handle means 10 is configured from one piece with the reinforcement means 12, wherein the reinforcement means 12 is connected at least in one connecting section 12.1, preferably two connecting sections 12.1 of the reinforcement means 12 with the outer side 3.2 of the area element 3. By such an arrangement particularly in which the connecting sections 12.1 are configured in a first and second edge 11.1, 11.2 of the load element 11, it is for example possible that by the load element 11 in a discharging condition I an grasping-in-area 15 is configured, wherein the load element 11 is spaced apart from the area element 3 at least areawise in the grasping-in-area 15 since the length of the load element 11 is independent from the area element 3. Preferably, the reinforcement means 12 can be connected materially bounded in a connecting section 12.1 of the reinforcement means 12 with the area element 3, wherein the reinforcement means 12 is preferably glued and/or welded to the area element 3. FIG. 7*b* shows the embodiment of the handle means 10 of FIG. 7*a* in a lateral view, wherein it is pointed out that on the other side 3.2 of the area element 3 a connecting section 12.1 of the reinforcement means 12 is intended such that an grasping-in-area 15 is formable by the load element 11. In this embodiment the connecting section 12.1 of the reinforcement means 12 further provides a load introduction area 16 of the handle means 10.

Figure 8:
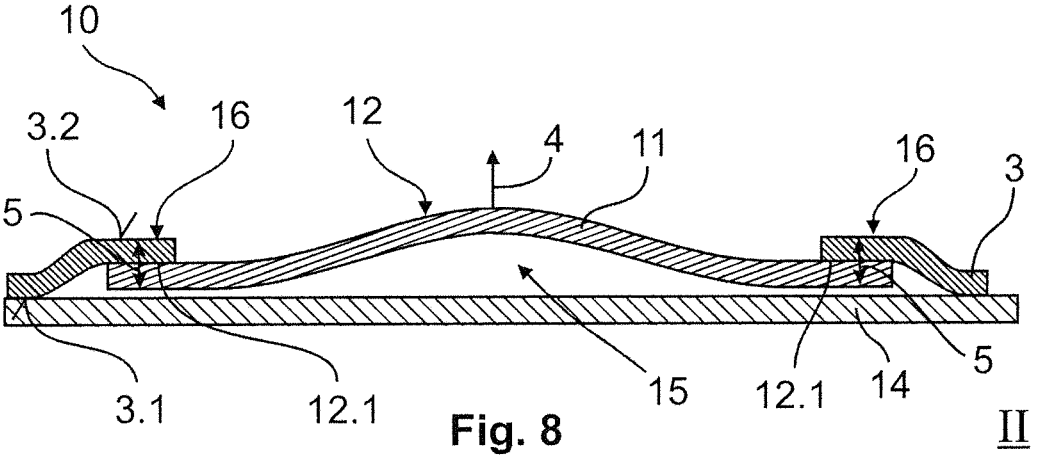
FIG. 8 shows a handle means of a sack according to the invention in a further embodiment in a schematic representation.

FIG. 8 shows a further embodiment of a handle means 10 according to the invention in a schematic sectional view. Thereby, the handle means 10 comprises a load element 11 which is configured from one piece with the reinforcement means 12. The reinforcement means 12 is further connected at the inner side 3.1 of the area element 3 of the sack 1 with an area element 3, wherein the load element 11 or the reinforcement means 12 is connected preferably materially bounded in a connecting section 12.1 of the reinforcement means 12 with the area element 3. Thereby, the handle means 10 is further in a load condition II such that this extends at least partially over the outer side 3.2 of the area element 3 and the grasping-in-area 15 is configured in which a user can grab into. Thereby, the load element 11 is arranged in an opening 13 of the area element 3, wherein the opening 13 is closed by a plane sealing element 14 such that bulk goods, which preferably abut at the inner side 3.1 of the area element 3 in case the sack is filled, cannot leak out of the opening 13. The connecting section 12.1 of the reinforcement means 12 thereby further provides a load introduction area 16 in which the area element 3 is loaded particularly by acting of a normal force 5 at least partially to a bending in case a load force 4 is applied to the shown load condition II.

Figure 9:
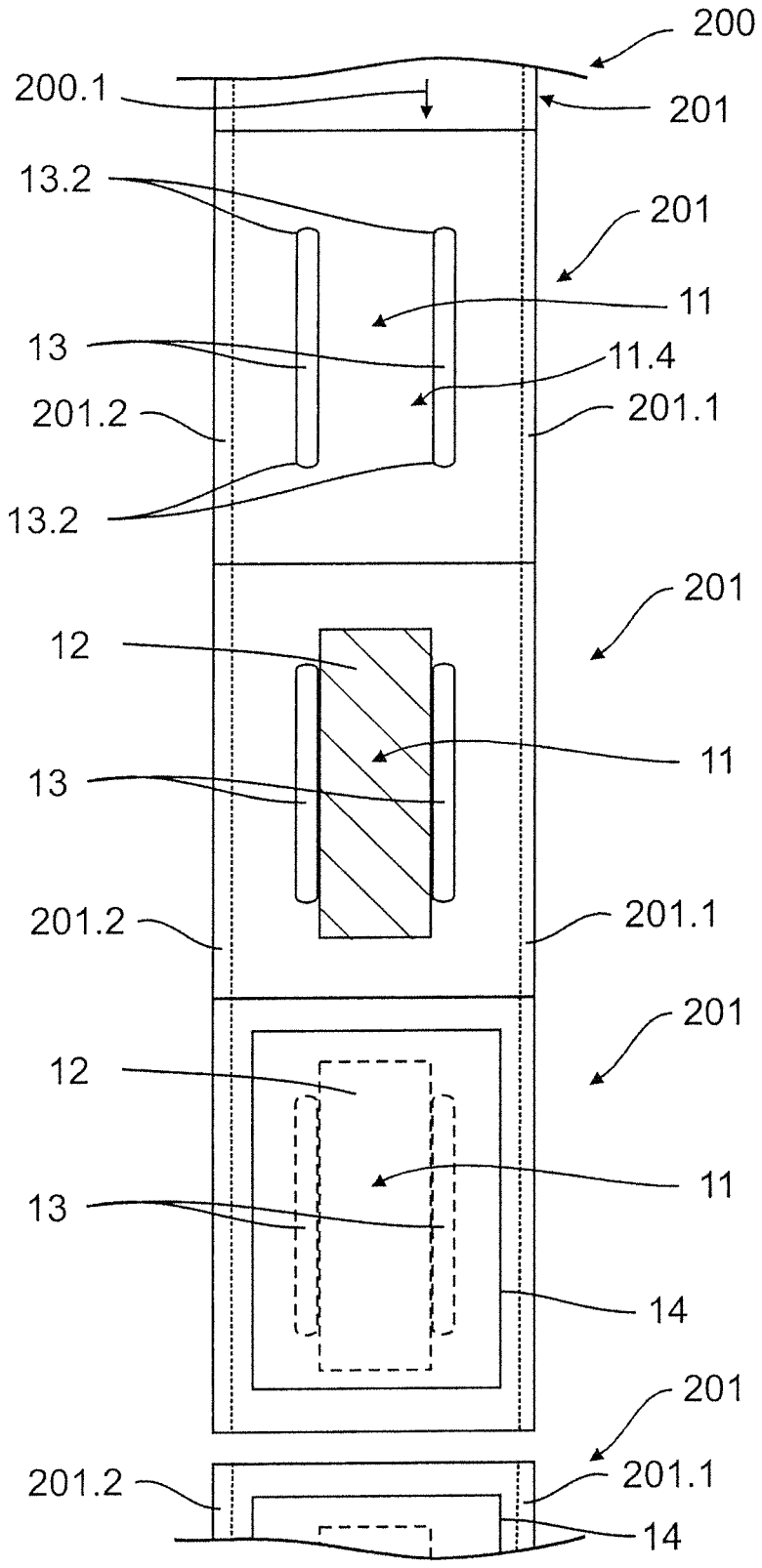
FIG. 9 shows a schematic method step according to the invention for the production of a sack in a further embodiment.

FIG. 9 shows method steps according to the invention for the production of the sack 1 in a further embodiment. Thereby, a plane material path 200 is provided which comprises a mesh and at least a plane area 201. Thereby, the material path 200 with further components like the plane area 201, which particularly comprises one section of the material path 200 and can later build a cover section of the completed sack, are shown only schematically, particularly from the inside of the later area element 3 such that particularly the dimensions like, for example, the width of the material path 200 are not the actual dimensions. The material path 200 can for example be provided from a circular woven tube, whereon the circular woven is cut subsequently to weaving. The material path 200 further comprises multiple plane areas 201 and moves along a transport direction 200.1 such that the plane areas 201 are performable in method steps one after another. Subsequently, to providing the flat material line 200 a provision of such a handle means 10 at the plane area 201 occurs that with a later using of the completed sack 1 a load force 4 at the load element 11 is applicable to the handle means 10 and the load element 11 is configured such that it extends at least in a load condition II, in which the load force 4 acts at least partially at the load element 11, opposite to the other side 3.2 of the area element 3. Thereby, the plane area 201 can at least partially or completely configure the area element 3 after completion of the sack 1. Thus, preferably initially openings 13 are introduced with smoothings 3.2 parallel to one another in the plane area 201 such that a first layer 11.4 of the load element 11 results. In a further step preferably a reinforcement means 12, particularly in form of a reinforcement sheet, is introduced and connected particularly centrally between the openings 13 to the flat area 201 such that the load element 11 is thickened in this area of the reinforcement means 12 and therewith reinforced such that a high rigidity of the handle means 10 is reachable. Here, it is alternatively possible that the reinforcement means 12 previous to introducing into the openings 13 is arranged on the plane area 201. In this case the reinforcement means 12 can be for example configured wider such that the openings 13 are at the same time introduced into the reinforcement means 12 and the flat area 201. In a further step preferably centrally via the load element 11 a plane sealing element 14 is applied which is arranged at the opening 13 such that a loss of bulk goods is prevented through the opening 13, wherein the sealing element 14 is circumferentially connected particularly with a plane area 201. Subsequently, a separation of at least one plane area 201 from the material path 200 occurs such that the plane area 201 is isolated. The separation of the flat area 201 can particularly alternatively occur directly after provision of the material path or an intermediate step during application of the handle means 10 in order to separately be able to handle the flat area. In a further course further the plane area 201 is processed to a cover, wherein the plane area 201 can be folded and/or can be connected to further plane areas 201 to the cover 2. Thereby, for example a first edge area 201.1 of the plane area 201 can be connected to a second edge area 201.2 of the plane area 201 such that a circumferential closed sleeve results, wherein for example in a bottom area further foldings can be performed. Preferably, the connection of the edge areas 201.1, 201.2 to a tube previous to separation of the plane area 201 occurs such that after the separation only the frontal and/or rear area is adjusted relatively to the transport direction 201 in order to form the cover 2. It is further possible that multiple plane areas 201 are connected to one another or further cover sections are added in order to form the cover. Particularly, by the shown method steps a sack according to a first embodiment can be produced, wherein preferably the handle means is configured according to an embodiment of FIG. 2 to 4 or 6. Further, it is possible that only an opening is introduced into the flat area 201 such that the shown method steps can be transferred to the handle means according to the embodiment of FIG. 8.

Figure 10:
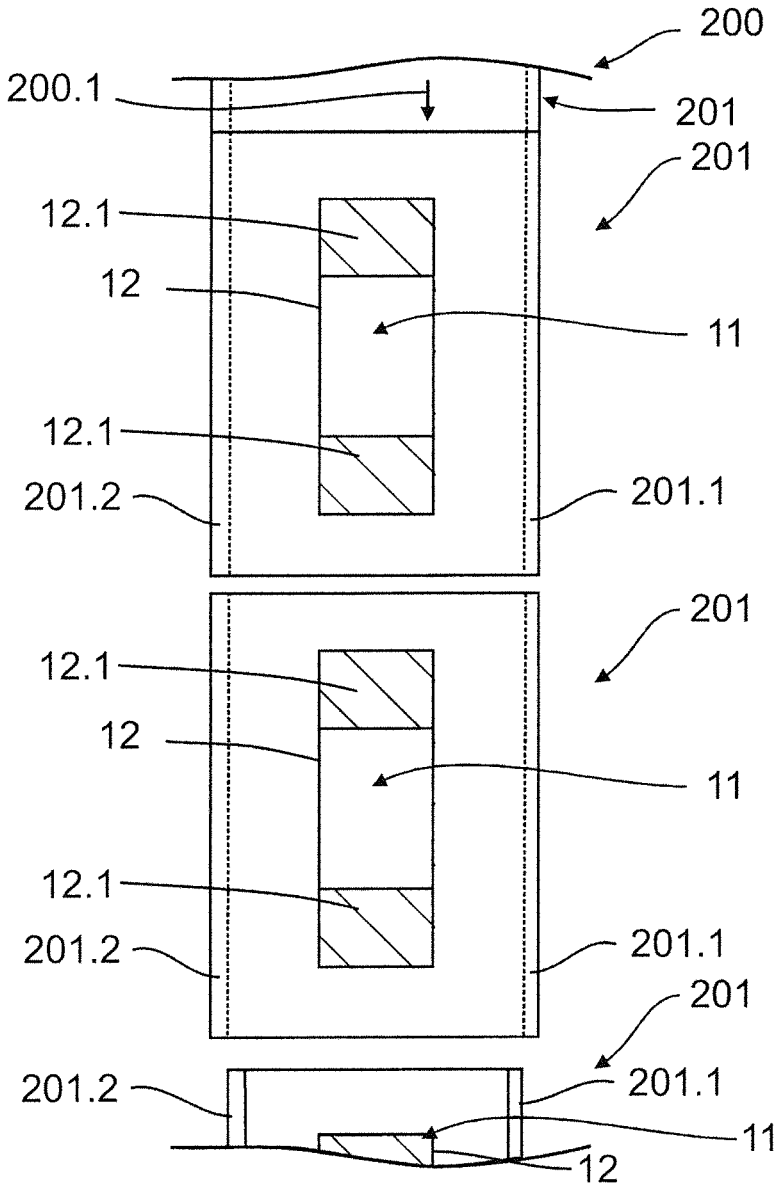
FIG. 10 shows a schematic method step according to the invention for the production of a sack in a further embodiment.

FIG. 10 shows method steps for the production of a sack 1 according to the invention in a further embodiment. Thereby, a flat material line 200 is provided which comprises a mesh and at least one flat area 201. The material path 200 is shown with further components like the plane area 201 which represents particularly a section of the material path 200 and can configure a cover section of the completed sacks, particularly in a later outer side 3.2 of the area element 3 such that, particularly the dimensions like for example the width of the material path 200 do not represent the actual dimensions. The material path 200 can for example be provided from a round woven tube which is cut off after weaving. The flat material line 200 further comprises multiple plane areas 201 and moves along a transport direction 200.1, such that for the plane area 201 method steps following one after another are performable. After the flat material line 200 is provided a provision of such a handle means 10 occurs at the plane area 201 that with a later use of the completed sack 1 a load force 4 is applicable at the load element 11 of the handle means 10 and the load element 11 is configured such that at least in a load condition II it extends at least area wise in which the load force 4 acts at the load element 11 according to the outer side 3.2 of the area element 3. Thereby, the plane area 201 can configure partially of completely the area element 3 after completion of the sack 1. Thus, further preferably a reinforcement means 12, particularly in form of a reinforcement sheet, is applied to at least one of the plane areas 201 such that the load element 11 is configured and connected in two connecting areas 12.2 with the plane area 201. Subsequently, a separation of at least one plane area 201 from the material path 200 occurs such that the plane area 201 is separated. The separation of the plane area 201 can occur, particularly also alternatively directly after the provision of the material path 200 or one of the intermediate steps during application of the handle means 10 in order to simply handle the plane area 201. In the further proceeding further the plane area 201 is processed to a cover, wherein the plane area 201 can be folded and/or can be connected with the further plane areas 201 to the cover 2. Thereby, for example a first edge area 201.1 of the plane area 201 can be connected with a second edge area 201.2 of the plane area 201 such that a circumferential closed cover results, wherein particularly in a bottom area further foldings can be performed. It is however likewise possible that multiple plane areas 201 are connected with one another or further cover sections can be added in order to form a cover. Particularly, by the shown method steps a sack according to the first embodiment can be produced, wherein preferably the handle means according to the embodiments of FIG. 5 or 7 is configured. Particularly, it can be intended that previous to separating the plane area 201 a configuration of a tube occurs and after separation an at least partial closing of the tube.

The previous description of the embodiments describes the present invention only within the scope of examples. Naturally, single features of the embodiments as far as technically meaningful can be freely combined with one another without leaving the scope of the present invention.

The invention claimed is:

1. A pinch bottom sack fillable with bulk goods comprising a sleeve with at least one area element, wherein the sleeve comprises a mesh and the area element a handle means comprising a load element at which a load force is applicable for lifting the sack, the load element comprises a reinforcement means, the reinforcement means being arranged in the center at the load element and at an inner side of the area element, the load element is configured such that it extends at least in some areas at least in a load condition in which the load force acts at the load element opposite to an outer side of the area element, parallel to the load element, two openings extend which comprise smoothings in a load introduction area of the handle at the area element, the reinforcement means is arranged such that an outer edge of the reinforcement means is between the two openings and the reinforcement means is connected materially bounded in two connecting sections at opposing ends of the reinforcement means with the area element, and a plane sealing element is arranged at the two openings such that a loss of bulk goods through the two openings is prevented, and a connecting section of the sealing element is configured at least partially tangential to the two openings and the smoothings and at least partially extends into a grasping-in-area of the load element;

wherein the load element is connected to an inner side of the area element at a first and a second end of the load element, and the mesh is a plurality of tapes each having a width between 2 mm and 4 mm and an area weight of the mesh is between 50 g/m$^2$ and 100 g/m$^2$.

2. The sack according to claim 1, wherein the handle means is turnable into a discharge condition and a load condition.

3. The sack according to claim 1, wherein the reinforcement means is configured from one piece with the load element.

4. The sack according to claim 1, wherein the load element is moveable.

5. The sack according to claim 4, wherein the two openings respectively have a width of 2 mm to 5 mm.

6. The sack according to claim 4, wherein the two openings respectively comprise a length greater than 90 mm in parallel to the load element.

7. The sack according to claim 4, wherein the plane sealing element connects to a circumferential about the two openings.

8. The sack according to claim 1, wherein at least one first layer of the load element is configured from one piece with the area element.

9. The sack according to claim 1, wherein the handle means comprises the grasping-in-area at least partially configurable by the load element, and the load element is grippable from below in the grasping-in-area at least mainly parallel to the outer side of the area element.

10. The sack according to claim 1, wherein the area element comprises a lateral fold.

11. The sack according to claim 1, further comprising a cover that comprises a filling limit, and above the filling limit a filling area allows a bulk good to be releasable from the sack and the handle means is underneath the filling limit.

12. The sack according to claim 1, wherein the outer side of the area element and/or an outer area of the load element is coated.

13. The sack according to claim 1, wherein the sack comprises a display area that guides a user to the handle means.

14. The sack according to claim 1, wherein the load element is configured such that through the load force at least mainly a normal force is introducible into the area element.

15. A method of producing the sack, particularly according to claim 1, comprising:

a) providing a flat material line comprising a mesh with at least a plane area, b) providing the handle means at the plane area such that with later use of the completed sack, a load force is applicable at a load element of the handle means and the load element is configured such that it at least partially extends at least in a load condition in which the load force acts at the load element opposing to the outer side of the area element, c) separating the plane area from the flat material line, and d) processing the at least one plane area to a cover of the sack.

16. The method according to claim 15, wherein a) comprises at least:

applying a coating on the flat material line such that the outer side of the area element of the sack is coated.

17. The method according to claim 15, wherein b) comprises at least:

applying the reinforcement means to the plane area.

18. The method according to claim 15, wherein b) comprises at least:

introducing the two openings in the plane area and/or in the reinforcement means.

19. The method according to claim 15, wherein processing of the plane area to a cover comprises at least one of:

separating the at least one plane area, repeatedly folding the plane area, joining at least one force edge area of the plane area with a second edge area of the plane area or a further plane area.

20. The method according to claim 15, wherein b) comprises at least:

applying a plane sealing element to the plane area, wherein the sealing element connects to the plane area, the reinforcement means and the load element.

* * * * *